US009724812B2

(12) United States Patent
Scabin et al.

(10) Patent No.: US 9,724,812 B2
(45) Date of Patent: Aug. 8, 2017

(54) CORDLESS CARTON CLOSING TOOL AND METHOD OF REPLACING A CARTON CLOSER CLINCHING MEMBER

(71) Applicant: STANLEY FASTENING SYSTEMS, L.P., North Kingstown, RI (US)

(72) Inventors: Gianpaolo Scabin, Lissone (IT); Brian McNeill, Warwick, RI (US); Jonathan D. Kalow, East Greenwich, RI (US); Brian C. Burke, Barrington, RI (US)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 1048 days.

(21) Appl. No.: 13/843,711

(22) Filed: Mar. 15, 2013

(65) Prior Publication Data

US 2014/0001226 A1 Jan. 2, 2014

Related U.S. Application Data

(60) Provisional application No. 61/665,516, filed on Jun. 28, 2012, provisional application No. 61/772,105, filed on Mar. 4, 2013.

(51) Int. Cl.

| | |
|---|---|
| ***B25C 5/02*** | (2006.01) |
| ***B25C 5/04*** | (2006.01) |
| ***B25C 5/15*** | (2006.01) |

(52) U.S. Cl.

CPC ..... *B25C 5/0207* (2013.01); *B25C 5/02* (2013.01); *B25C 5/04* (2013.01); *B25C 5/15* (2013.01); *Y10T 29/4973* (2015.01)

(58) Field of Classification Search

CPC ... B25C 5/0207; B25C 5/0264; B25C 5/0271; B25C 5/0285; B25C 5/02; B25C 5/15; B25C 5/0278

See application file for complete search history.

(56) References Cited

U.S. PATENT DOCUMENTS 2,897,502 A * 8/1959 Schafroth ..... B25C 5/0264 227/108
2,899,679 A * 8/1959 Allen ..... B65B 51/05 227/108
3,191,841 A * 6/1965 Schafroth ..... B25C 1/041 227/108
3,224,657 A * 12/1965 Zike ..... B25C 5/0264 227/108

(Continued)

*Primary Examiner* — Andrew M Tecco
(74) *Attorney, Agent, or Firm* — Pillsbury Winthrop Shaw Pittman LLP

(57) ABSTRACT

A fastener driving tool includes a housing, a drive track within the housing, a magazine connected to the housing and configured to hold a supply of fasteners and to provide a leading fastener to the drive track, a driver configured to move downward in the drive track and drive the leading fastener into a workpiece during a drive stroke, a mount connected to the driver, and a clincher operatively connected to the housing and to the mount. The clincher is configured to engage the leading fastener during the drive stroke and move into a clinching position at the end of the drive stroke to clinch the fastener to the workpiece. A motor is configured to rotate a crank arm, and a connecting rod is pivotably connected to the mount at one end portion thereof and pivotably connected to the crank arm at an opposite end portion thereof.

24 Claims, 7 Drawing Sheets

(56) References Cited

U.S. PATENT DOCUMENTS 3,313,463 A * 4/1967 Boucher ..... A47G 27/0487 227/108
3,403,832 A * 10/1968 Pabich ..... B21F 45/24 227/108
3,504,837 A * 4/1970 Cairatti ..... B25C 5/0264 227/108
3,504,839 A * 4/1970 Cairatti ..... B25C 5/0271 227/108
4,573,624 A 3/1986 Müller et al.
4,640,452 A * 2/1987 Matt ..... B25C 1/06 173/53
4,671,444 A * 6/1987 Oliver ..... B25C 5/0271 227/108
4,700,876 A 10/1987 Wingert
4,770,335 A 9/1988 Wingert
4,811,885 A 3/1989 Lai
4,834,278 A 5/1989 Lin
4,858,813 A 8/1989 Wingert
4,946,087 A 8/1990 Wingert
4,953,774 A 9/1990 Lai
5,118,023 A 6/1992 Fushiya et al.
D330,836 S 11/1992 Fushiya et al.
5,443,196 A 8/1995 Burlington
5,503,319 A 4/1996 Lai
5,605,268 A 2/1997 Hayashi et al.
6,604,666 B1 * 8/2003 Pedicini ..... B25C 1/06 173/124
6,753,673 B2 6/2004 Shiue et al.
6,971,567 B1 * 12/2005 Cannaliato ..... B25C 1/06 173/1
7,248,019 B2 7/2007 Ookubo et al.
7,513,402 B2 4/2009 Miyashita et al.
7,918,374 B2 4/2011 Gardner et al.
8,011,441 B2 9/2011 Leimbach et al.
8,011,547 B2 9/2011 Leimbach et al.
8,550,323 B2 * 10/2013 Fujimoto ..... B25C 1/06 227/132
2002/0134811 A1 9/2002 Napier et al.
2011/0000949 A1 1/2011 Ito et al.
2011/0036885 A1 2/2011 Leimbach et al.
2011/0036886 A1 2/2011 Leimbach et al.
2011/0180580 A1 7/2011 Gardner et al.
2011/0198381 A1 8/2011 McCardle et al.
2011/0248062 A1 * 10/2011 Fujimoto ..... B25C 1/06 227/8
2011/0278340 A1 11/2011 Leimbach et al.
2011/0290846 A1 12/2011 Leimbach et al.
2011/0315736 A1 12/2011 Leimbach et al.

* cited by examiner

CORDLESS CARTON CLOSING TOOL AND METHOD OF REPLACING A CARTON CLOSER CLINCHING MEMBER

CROSS-REFERENCE TO RELATED APPLICATIONS

This application claims the benefit of priority from U.S. Provisional Patent Application Ser. No. 61/665,516, filed Jun. 28, 2012, and U.S. Provisional Patent Application Ser. No. 61/772,105, filed Mar. 4, 2013, the entire contents of both of which are incorporated herein by reference.

FIELD

This invention relates to fastener driving devices and more particularly to cordless fastener driving tools of the type including clinching mechanisms for securing cartons in a closed manner, as well as to a method for replacing a carton closer clinching member.

BACKGROUND

Power operated fastener driving tools are traditionally used in industrial applications where compressed air provides a convenient power source. Because of the nature of the compressed air power source and the expense involved in heavy duty industrial fastener driving tools, such tools are generally not suitable for use in fastening jobs where maneuvering is required, space is limited, or compressed air is not available. Manually operated fastener driving tools are also used in industrial applications. However, in many of the jobs where manually operated fastener driving tools are used, considerable operator fatigue may be involved because a manual fastener driving tool requires a large user actuation force.

Existing carton closing tools, due to their structural configuration, require significant tool disassembly to replace the clinching members of the tools. The level of disassembly needed for replacing the clinching member in existing tools is difficult and cumbersome, as disassembly involves removing numerous parts of the tool, even those parts that are remotely related to the clinching operations. In some instances, replacing the clinching members requires that the entire tool be disassembled.

Replacement of clinching members is desirable in at least the following situations. Carton closing tools use different sized clinching members for different fastener applications. Therefore, replacing clinching members depending on the fastener applications is a common occurrence. Even if the same sized clinching member is used for a particular fastener application, clinching members are components that will undergo wear and need to be replaced during the life of the tool.

As a result, there is a need in the art for a more efficient and less cumbersome way to replace clinching members for different fastener applications or when clinching members are worn.

SUMMARY

As an alternative to some of these challenges, an electrically-operated fastener driving tool can be used. An electrically operated fastener driving tool avoids the inconvenience of the compressed air power source for power-operated tools in industrial applications. An electrically operated tool can use the electrical energization of a motor or solenoid to accomplish the driving action. Such a tool can be used commercially in work areas where it would constitute an inconvenience to provide a supply of compressed air or manual labor as sources of power.

Accordingly, embodiments of the present invention include an electric fastener driving tool for driving staples to fasten carton flaps in a closed manner. In a further embodiment, the tool is a battery-powered fastener driving tool. The tool relies on a battery to supply energy to an electric motor when the trigger is actuated. The present invention thus obviates the disadvantages noted above. Thus, the fastener driving tool of the embodiments herein can function in the above-mentioned applications where prior art devices are inconvenient, as well as all other applications to which the prior art devices could be used. Also, the fastener driving tool is portable and thereby free from being tethered to a work area. As such, the tool can be used in a variety of locations with minimal set-up.

According to an aspect of the present invention, there is provided a fastener driving tool that includes a housing, a drive track within the housing, a magazine connected to the housing and configured to hold a supply of fasteners and to provide a leading fastener to the drive track, a driver configured to move downward in the drive track and drive the leading fastener into a workpiece during a drive stroke, and upward in the drive track during a return stroke, a mount connected to the driver, and a clincher operatively connected to the housing and to the mount. The clincher is configured to engage the leading fastener during the drive stroke and move into a clinching position at the end of the drive stroke to clinch the fastener to the workpiece. The tool includes a motor configured to rotate a crank arm, and a connecting rod pivotably connected to the mount at one end portion thereof and pivotably connected to the crank arm at an opposite end portion thereof. The connecting rod is configured to pull the mount and the driver downward through the drive stroke when the crank arm rotates from a first position to a second position.

In an embodiment, the mount is integral with the driver.

In an embodiment, the connecting rod is configured to pull the mount and the driver upward through the return stroke when the crank arm rotates from the second position to the first position.

In an embodiment, the first position and the second position are 180° from each other.

In an embodiment, the clincher includes a first link pivotably connected to the mount, and a second link pivotably connected to the mount; a first clincher arm pivotably connected to the first link and pivotably connected to the housing, and a second clincher arm pivotably connected to the second link and pivotably connected to the housing; and a first clincher anvil connected to the first clincher arm at a first end thereof, and a second clincher anvil connected to the second clincher arm at a first end thereof, wherein a second end of the first clincher anvil and a second end of the second clincher anvil are each configured to move downwardly and inwardly towards each other to engage the leading fastener during the drive stroke and clinch the leading fastener to the workpiece at the end of the drive stroke.

In an embodiment, the first clincher anvil is integral with the first clincher arm, and wherein the second clincher anvil is integral with the second clincher arm.

In an embodiment, the fasteners are staples. Each staple includes a crown and two legs extending from the crown. The driver is configured to engage the crown and each of the second ends of the first and second clincher anvils is configured to engage one of the legs.

In an embodiment, the first clincher anvil and the second clincher anvil each have an arcuate shape and extend arcuately downwardly from the respective second ends of the first clincher arm and the second clincher arm.

In an embodiment, a distal tip of the first clincher anvil and a distal tip of the second clincher anvil are each configured to pierce through the workpiece as the first clincher anvil and the second clincher anvil move downwardly and inwardly into the clinching position.

In an embodiment, the workpiece is a corrugated fiberboard container.

In an embodiment, the fastener driving tool also includes a trigger mechanically coupled to a handle portion of the housing and electrically coupled to the motor, and an energy storage device connected to the handle portion. The trigger is configured to selectively provide electric power from the energy storage device to the motor when a user of the fastener driving tool operates the trigger while holding the handle portion.

In an embodiment, the energy storage device includes a battery pack.

According to an aspect of the present invention, there is provided a method for replacing a clincher anvil of a clincher assembly of a fastener driving tool. The fastener driving tool includes a housing, a drive track within the housing, a driver configured to move downward in the drive track and drive the leading fastener into a workpiece during a drive stroke, a mount operatively connected to the driver, and the clinching assembly connected to the mount and to the housing. The method includes removing a first connector connecting the mount to a connecting rod operatively connected to a motor of the fastener driving tool through a first aperture in the housing, moving the mount and the driver downward in the drive track, aligning second connector connecting the clincher anvil to a portion of the clinching assembly with a second aperture in the housing, removing the second connector through the second aperture, removing the clincher arm from the fastener driving tool, aligning a replacement clincher arm with the portion of the clinching assembly, inserting the second connector through the second aperture, securing the replacement clincher arm to the portion of the clinching assembly, moving the mount and the driver upward in the drive track, inserting the first connector through the first aperture and into the mount, and connecting the mount to the connecting rod.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The numerous advantages of the present invention may be better understood by those skilled in the art by reference to the accompanying figures. In the drawings, like reference numerals designate corresponding parts throughout the several views.

DETAILED DESCRIPTION

Reference will now be made in detail to the present embodiments of the invention, examples of which are illustrated in the accompanying drawings.

Figure 1:
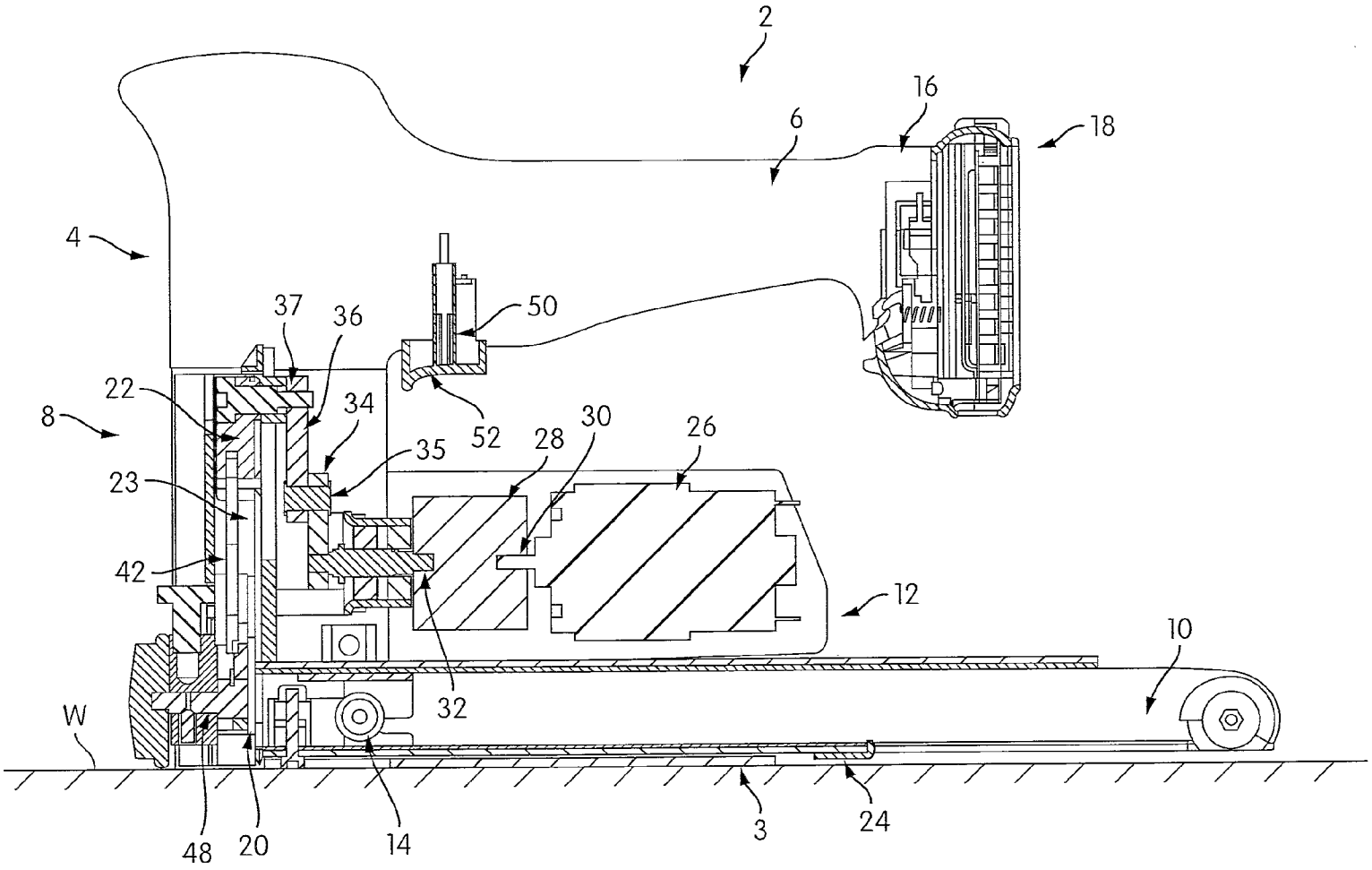
FIG. 1 illustrates a cross-sectional view of an exemplary fastener driving tool constructed in accordance with embodiments of the invention.

Referring now more particularly to the drawings, there is shown in FIG. 1, a cross-sectional side view of a fastener driving tool, generally indicated at 2, which embodies the principles of the present invention. As shown, the tool is an electrically actuated portable-type tool capable of driving staples and clinching the same into workpieces, such as carton flaps and the like. The staples can be carried as a supply within the tool in the form of elongated preformed or non-preformed staples interconnected together in parallel relation and arranged linearly within a magazine or in a coil form in a coil magazine.

As shown in FIG. 1, the tool 2 includes a housing section, generally indicated at 4, which provides a handle portion 6 adapted to be gripped by the hand of a user, and a vertical section 8 extending forwardly and downwardly from the forward end of the handle 6. The tool includes a tool base 3 that contacts a surface of a workpiece W during use. A magazine 10 is connected to the nose portion of the tool and a motor-transmission unit 12 is disposed between the magazine 10 and the handle 6. The housing section 4 can be integral with the motor-transmission unit 12 and formed in a single casting. Alternatively, the housing section 4 and the motor-transmission unit 12 can be separately cast and the motor-transmission unit mounted onto the housing section 4. The magazine 10 is provided for storing and arranging staples for delivery to a fastener driving assembly. The magazine 10 can be an elongated member as shown in FIG. 1 in which staples are arranged linearly in parallel. Alternatively, the staples can be arranged in a coil for a more compact tool. The magazine includes a pusher 14 for pushing staples from an insertion end of the tool to a delivery end of the tool where the staples can be driven by a driver 23, which may be in the form of a driver blade, of the driving assembly and embedded into the workpiece W. The magazine also includes a magazine release lever 24 to disconnect the magazine 10 from the tool 2 when a staple is jammed in the tool.

In an embodiment, the handle 6 extends from the housing section 4 to a handle end portion 16 having an energy storage device, which may include a battery pack 18. The battery pack 18 is configured to engage the handle end portion 16 and provide power to a motor 26 in the motor transmission unit 12 such that the tool 2 can drive one or more nails which are fed from the magazine 10. Although the battery pack 18 is illustrated as being connected to the handle end portion 16, the battery pack 18 can be located anywhere on the tool 2. In addition, although the energy storage device is illustrated as being a battery pack, embodiments of the invention are not limited to battery packs being the energy storage device.

Provided in the vertical section 8 of the housing section 4 is the driver 23 of the fastener driving assembly. A driver mounting block, i.e. mount 22 is located in a drive channel and moves through successive operating cycles, each of which includes a downward drive stroke and an upward return stroke. The mount 22 has connected thereto, the driver 23. Actuation of the driver 23 drives staples, which are sequentially fed from the magazine 10 to a drive track 20 within the housing 4, into a clincher assembly 40, which may also be referred to herein as a clincher, then into the workpiece W. As shown, the driver 23 is connected to the upper end of the mount 22 and is forced to follow the linear motion of the mount. In an embodiment, the mount is integral with the driver.

Figure 4:
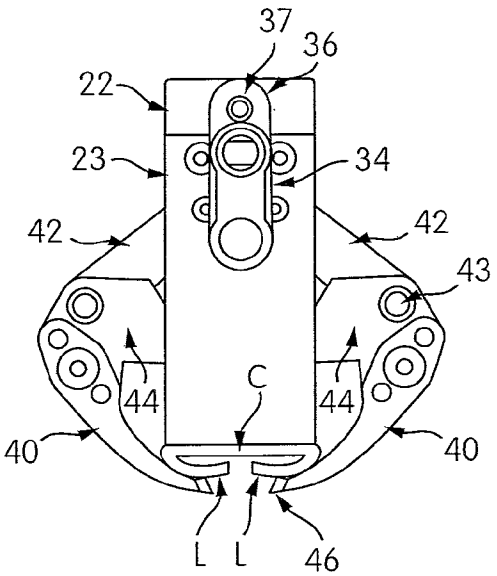
FIG. 4 illustrates the fastener clinching assembly of FIG. 2 in a downward and closed position.
Figure 3:
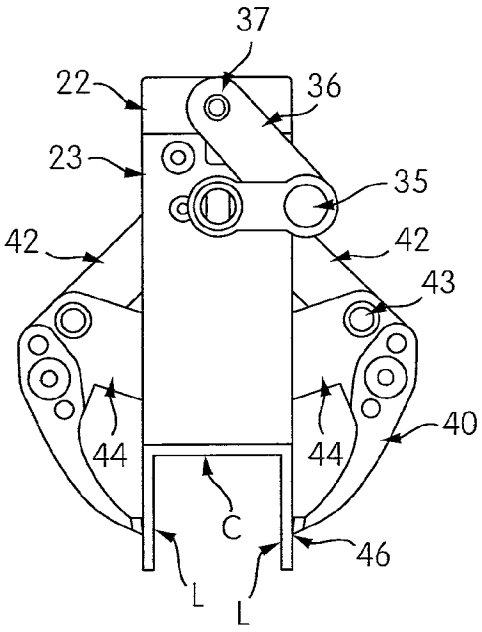
FIG. 3 illustrates the fastener clinching assembly of FIG. 2 at the beginning of actuation.
Figure 2:
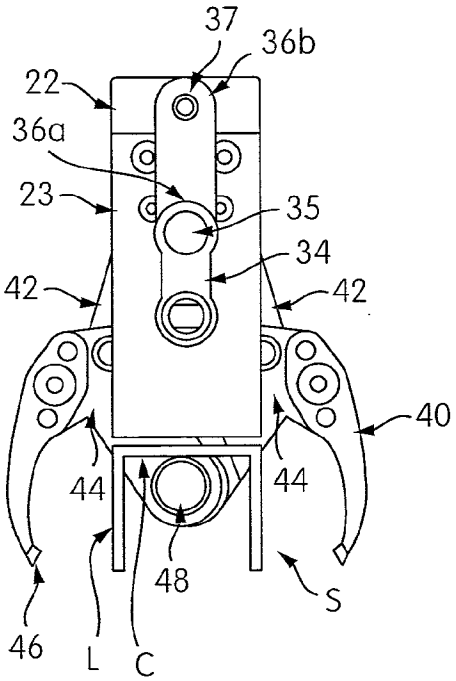
FIG. 2 illustrates a fastener clinching assembly of the tool of FIG. 1 in an upward and open position.

As shown in FIGS. 1-4, and particularly in FIGS. 2-4, a connecting rod 36 is pivotably connected at a lower end 36*a* thereof through a lower pivot pin 35 to a crank arm 34, which is connected to a crankshaft 32. The connecting rod 36 is pivotably connected at an upper end 36*b* to the mount 22 through an upper pivot pin 37. The connecting rod 36 pivots outwardly from the center line of the mount 22 as the crank arm 34 moves the lower end 36*a* of the connecting rod 36. The connecting rod 36 pulls the mount 22 downward toward the nose through the drive stroke. Therefore, as the crank arm 34 rotates, the connecting rod 36 acts as a linear actuator by converting the rotational motion of the crank arm 24 into linear motion of the mount 22 through a drive stroke in the drive track 20. One complete 360-degree rotation of the crankshaft 32 and therefore the crank arm 34 is equivalent to one complete downward and upward cycle of the mount 22.

The clincher assembly 40, which is shown in more detail in FIGS. 2-4, is mounted proximal to the nose of the tool 2 in a position to define the lower portion of the drive track 20. The clincher assembly 40 includes a pair of clincher linkages 42, a pair of clincher arms 44, and a pair of clincher anvils 46. During the down stroke of the mount 22, the driver 23 drives a staple into the workpiece W. The closing of the staple within the carton is achieved by the clincher assembly 40. Upper ends of the clincher linkages 42 are pivotably connected to the mount 22 such that the downward movement or downstroke of the mount 22 moves the clincher linkages 42 downward. A lower end of each clincher linkage 42 is connected to a respective clincher arm 44. The downward motion of the mount 22 causes the clincher arms 44 to rotate about a pivot pin 48. The upstroke of mount 22 returns the driver 23 and the clincher arms 44 to the home or at-rest positions.

As shown in FIG. 2, the clincher assembly 40 is shown in a retracted state. The clincher arms 44 are pivoted to the lower end of the housing section 4 by the pivot pin 48 and are further pivotable on the clincher linkage 42 by pivot members 43. Each clincher arm 44 has mounted on the outer end thereof an arcuate clincher anvil 46 which, when the clincher assembly 40 is disposed in its retracted position, as shown in FIG. 2, extends arcuately downwardly from the end of the associated clincher arm 44. In order to accomplish the clinching action, the clincher anvils 46 are moved downwardly and inwardly along an arcuate path into a clinching position. This movement is accomplished in response to the downward movement of the mount 22 by means of the connecting rod 36 being pivoted at its upper end through the upper pivot pin 37, and at its lower end to the crank arm 34. In an embodiment, each clincher anvil 46 is integral with a corresponding clincher arm 44.

The clincher assembly 40, crank arm 34 and crankshaft 32 are actuated by a manual actuating mechanism or trigger assembly, generally indicated at 50, shown in FIG. 1, which is operable to activate the motor 26. As best shown in the Figure, the trigger assembly 50 includes a trigger member 52 which is adapted to be digitally engaged by a user grasping the housing handle portion 6.

The motor 26 is actuated by the trigger assembly 50. The trigger assembly 50 is mechanically coupled to handle 6 and electrically coupled to motor 26 such that the trigger assembly selectively provides electric power to motor assembly. The motor 26 includes a rotatable output shaft 30 that extends into the gear reduction mechanism 28, which reduces the rotational speed of the output shaft 30 and causes rotation of the crankshaft 32 at the reduced rotational speed.

The electric motor 26 provides a power source to the tool 2 to operate the clincher assembly 40 as shown in FIGS. 2-4. In FIG. 2, the tool 2 is in a resting state. The mount 22 is in a top position before the actuating mechanism or trigger member 52 is engaged. In this state, the clincher anvils 46 are open. The leading staple S is in the magazine and connected to the remaining stick of staples.

With the tool 2 provided with a staple supply in the manner indicated above, the staples being formed in a U-shaped or flat configuration; and with the leading staple S disposed within the drive track 20, it will be understood that when the user actuates the trigger member 52, the connecting rod 36 will be moved through a drive stroke carrying with it the mount 22, and the clincher assembly 40.

Referring now more particularly to FIGS. 3 and 4, the construction and operation of the clincher assembly 40 of the embodiments of the present invention is shown therein.

FIG. 3 illustrates the initial actuation of the tool when the trigger 52 is actuated, which causes the mount 22 to move through the drive stroke. During the initial portion of the drive stroke, the lower end of the driver 23 engages the crown C of the staple within the drive track 20 and moves the same downwardly. In addition, the clincher assembly 40 is operated so that the clincher anvils 46 thereof are moved into a position to receive the free ends of the legs L of the staple being driven as the latter move outwardly of the lower end of the drive track and into the workpiece. The clincher anvils 46 contact with the legs L of the leading staple S which has been pushed to the delivery end of the tool 2 by the pusher 14 of the magazine 10. At this stage, the legs L of the staple are being pushed into the workpiece W. In FIG. 4, the mount 22 is in a bottom position while the clincher anvils 46 are closed and fully pivoted toward each other, bending the legs L of the leading staple S toward each other. The clincher anvils 46 are also forced into the workpiece to press the legs L of the leading staple S toward each other. By the end of the drive stroke of the mount 22, the legs of the driven staple are clinched on the clincher anvils 46, as illustrated in FIG. 4.

The body of the clincher arms 44 can be metallic and formed from steel, for example. Alternatively, the body of the clincher arms can be titanium or other rigid metal. Other materials that can be used to form the clincher arms include a rigid resin material, plastic or a composite material. Further, a combination of materials or material properties can be used for the clincher arms.

The motor 26 drives the transmission or gear reduction mechanism 28, which in turn can actuate and advance the mount 22 to cause the driver 23 to strike the crown C of the leading staple S shown in FIGS. 2-4.

For the purpose of effecting the movement of the mount 22 through successive operative cycles of movement, the battery pack 18 supplies energy to an electric motor. The motor 26, can be carried by the housing 4 or the motor-transmission unit 12 in a position parallel to the handle 6 and rearwardly of the housing section 4. The gear reduction mechanism 28, which may be a planetary gear reduction mechanism, is also carried by the housing 4 or motor-transmission unit 12. The gear reduction mechanism 28 is rotatably connected to the motor 26 through the motor output shaft 30 so that the rotation of the motor output shaft 30 rotates the gear reduction mechanism 28. The gear reduction mechanism 28 transmits a rotational force to the crankshaft 32. The crankshaft 32 is rotatably connected to the crank arm 34. The rotational energy of the motor 26 is transmitted through the gear reduction mechanism 28 to the crankshaft 32 to reduce the speed of rotation and increase the torque applied to the crank arm 34. The crank arm 34 rotates along a circular path about the crankshaft 32. When the trigger member 52 is actuated and the safety is engaged, a connection is made between the battery 18 and a microprocessor unit. If the voltage of the battery 18 is within predetermined operating limits (in terms of voltage, current and temperature) the microprocessor applies a voltage to the motor 26, which begins the actuation sequence. The motor 26 will rotate the crankshaft 32, which in turn simultaneously advances the mount 22 and extends the clincher arms 44 driving the staple into the carton or workpiece W. The motor 26 will then continue to turn, returning both the driver 23 and clincher arms 44 until the mount 22 is sensed by a proximity sensor signaling to the microprocessor that the cycle has concluded. At this point, the microprocessor sends a braking signal to the motor 26 and waits for the user to release and re-engage the trigger 52 prior to another cycle commencing. As a result, the torque is applied to the crank arm 34.

Figure 5:
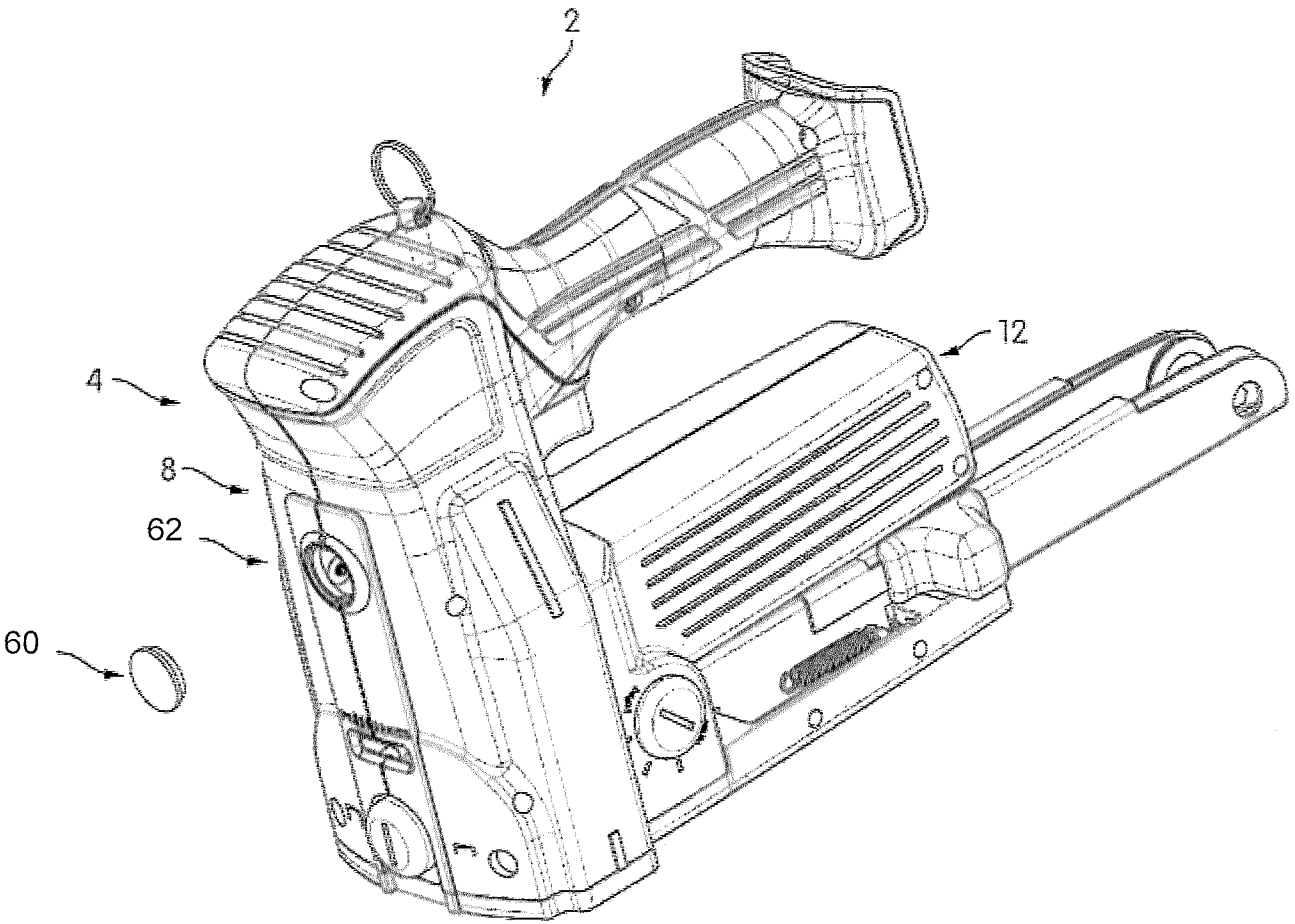
FIG. 5 illustrates a perspective view of the fastener driving tool of the embodiment of FIG. 1 having a connector cover removed.

In the event the clincher anvils 46 are worn and need replacing, or a different size of clincher anvils 46 is desired, a method of replacing clincher anvils 46 in the tool 2 is provided by an embodiment of the present invention illustrated in FIGS. 5-9. The disclosed method is different and less cumbersome than that required for existing carton closing tools of this type. In an embodiment of the present invention, the method includes removing an upper pivot pin cover 60 from the vertical section 8 of the housing 4, as illustrated in FIG. 5. Removing the upper pivot pin cover 60 from the housing 4 exposes the upper pivot pin 37 through an aperture 62. In an embodiment of the tool 2 of the present invention, the upper pivot pin cover 60 is a resilient rubber plug that can be removed by being pried off, such as with a flat blade screwdriver. In an embodiment of the tool 2 of the present invention, the upper pivot bolt cover 60 may be a threaded plug and/or a rigid plug.

Figure 6:
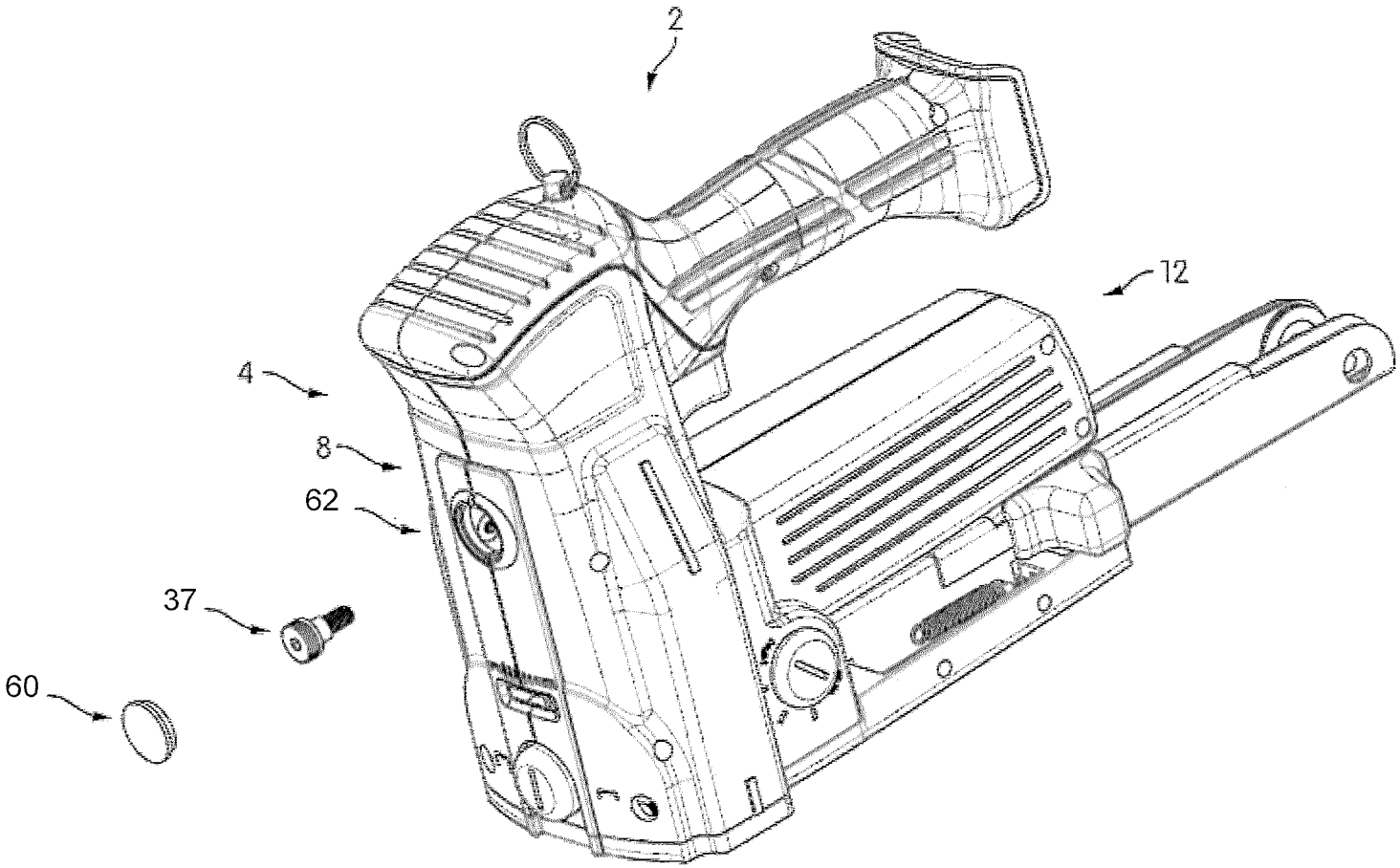
FIG. 6 illustrates a perspective view of the fastener driving tool of FIG. 5 with a connector removed.

After the upper pivot pin cover 60 has been removed from the housing 4, the exposed upper pivot pin 37 may be removed from the housing 4, as illustrated in FIG. 6. As described above, the mount 22 is connected to the connecting rod 36 through the upper pivot pin 37. Therefore, when the upper pivot pin 37 is removed from the tool 2, the mount 22 is free to move from an upper position of the drive stroke vertically downward to a bottom position of the drive stroke of the driver 23, which will cause the clincher assembly 40 to also move vertically downward.

Figure 7:
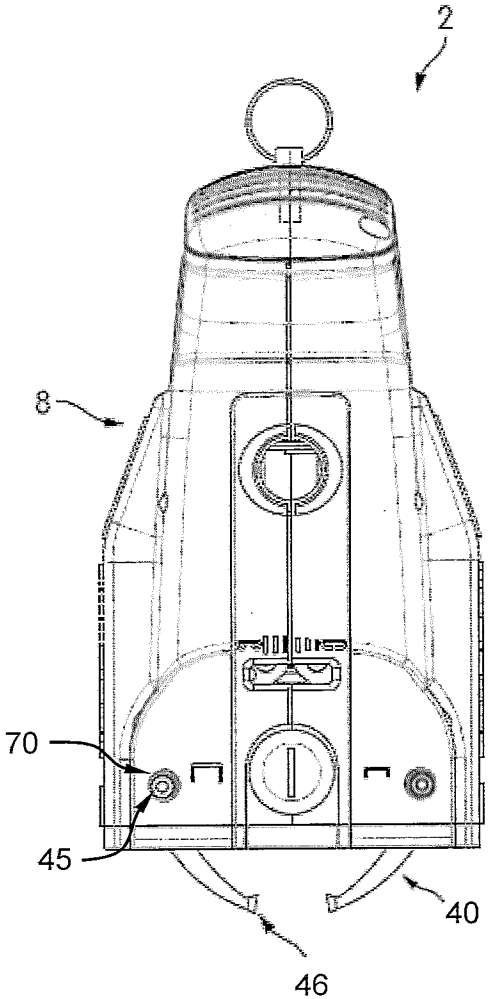
FIG. 7 illustrates a front view of the fastener driving tool of FIG. 6 in which clinching members extend through the bottom of the tool.
Figure 8:
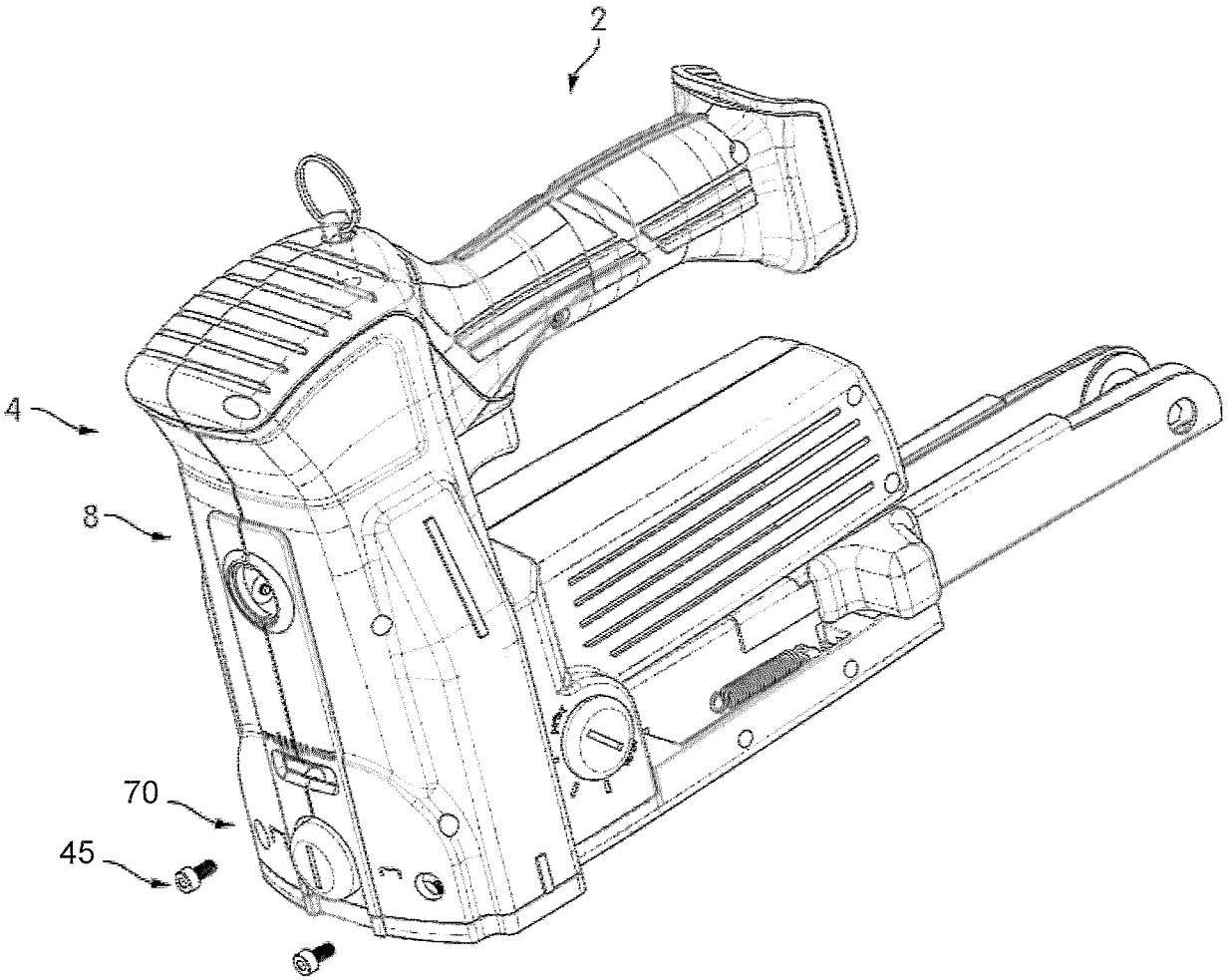
FIG. 8 illustrates a perspective view of the fastener driving tool of FIG. 7 in which clinching member connectors are removed from the tool.

As illustrated in FIG. 7, the downward movement of the clincher assembly 40 causes the distal ends of the clincher anvils 46 to extend out of the vertical section 8 of the housing. FIG. 7 also illustrates two connectors 45, which may be bolts, that connect the clincher anvils 46 to the clincher arms 44 are now coaxial with apertures 70 through the vertical section 8 of the housing. This alignment of the bolts 45 with the apertures 70 allows the bolts 45 to be removed through the apertures 70, as illustrated in FIG. 8.

Figure 9:
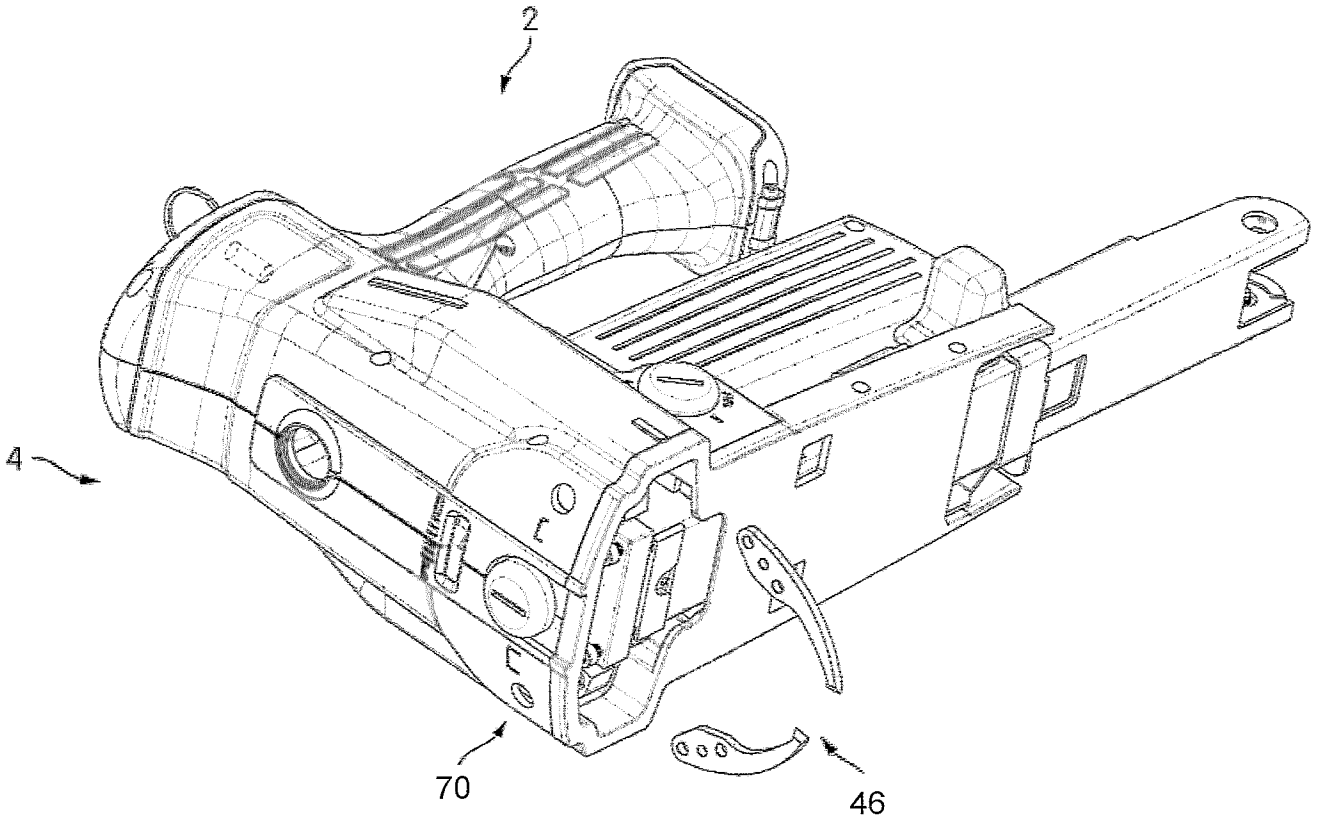
FIG. 9 illustrates a bottom perspective view of the fastener driving tool of FIG. 8 after removal of the clinching members from the fastening driving tool.

Upon removing the bolts 45 from the tool 2, the clincher anvils 46 are freed from the rest of the clinching assembly 40 and may be removed from the tool, as illustrated in FIG. 9. In order to install new clincher anvils in the tool 2, the method described above with respect to FIGS. 5-9 may be reversed.

For example, replacement clincher anvils may be aligned with their respective clincher arms 44, and the bolts 45 that were removed may be inserted through the apertures 70 in the housing 4. The replacement clincher anvils may then be secured to the clincher arms 44. After the replacement clincher anvils are secured to the clincher arms 44, the mount 22 and the driver 23 may be moved upward in the drive track 20. The pivot pin 37 may then be inserted through the aperture 62 in the housing 4 and into the mount 22 and the connecting rod 36, thereby connecting the mount 22 to the connecting rod 36.

As a result of embodiments of the present invention, the method of replacing the clincher anvils 46 is more user-friendly. In addition, the disclosed method of clincher member replacement minimizes the number of parts that need to be removed from the tool for access to the clincher anvils 46.

While the fastener driving tool is illustrated as being battery-powered, those skilled in the art will appreciate that the invention, in its broader aspects, may be constructed somewhat differently and that aspects of the present invention may have applicability to other electrically powered driving tools, such as those powered by solar energy. In addition, to electronic powered tools, the tool can also be powered by gas-combustion, or hand-operated with a lower mechanical advantage.

Although staples are illustrated, the embodiments described herein include, but are not limited to, nails, brads, clips or any such suitable fastener that could be driven into the workpiece.

Furthermore, while aspects of the present invention are described herein and illustrated in the accompanying drawings in the context of a fastener driving tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A fastener driving tool, comprising:

a housing;

a drive track within the housing;

a magazine connected to the housing and configured to hold a supply of fasteners and to provide a leading fastener to the drive track;

a driver configured to move downward in the drive track and drive the leading fastener into a workpiece during a drive stroke, and upward in the drive track during a return stroke;

a mount connected to the driver;

a clincher operatively connected to the housing and to the mount, the clincher being configured to engage the leading fastener during the drive stroke and move into a clinching position at the end of the drive stroke to clinch the fastener to the workpiece;

a motor configured to rotate a crank arm;

a connecting rod pivotably connected to the mount at an upper end portion thereof and pivotably connected to the crank arm at a lower end portion thereof, the connecting rod being configured to pull the mount and the driver downward through the drive stroke when the crank arm rotates from a first position to a second position, wherein, as the crank arm rotates from the first position to the second position, the crank arm moves the lower end portion of the connecting rod therewith.

2. The fastening driving tool according to claim 1, wherein the mount is integral with the driver.

3. The fastening driving tool according to claim 1, wherein the connecting rod is configured to pull the mount and the driver upward through the return stroke when the crank arm rotates from the second position to the first position.

4. The fastening driving tool according to claim 3, wherein the crank arm rotates 180° between the first position and the second position.

5. The fastening driving tool according to claim 1, wherein the clincher comprises:

a first link pivotably connected to the mount, and a second link pivotably connected to the mount;

a first clincher arm pivotably connected to the first link and pivotably connected to the housing, and a second clincher arm pivotably connected to the second link and pivotably connected to the housing; and a first clincher anvil connected to the first clincher arm at a first end thereof, and a second clincher anvil connected to the second clincher arm at a first end thereof, wherein a second end of the first clincher anvil and a second end of the second clincher anvil are each configured to move downwardly and inwardly towards each other to engage the leading fastener during the drive stroke and clinch the leading fastener to the workpiece at the end of the drive stroke.

6. The fastener driving tool according to claim 5, wherein the first clincher anvil is integral with the first clincher arm, and wherein the second clincher anvil is integral with the second clincher arm.

7. The fastener driving tool according to claim 5, wherein the fasteners are staples, wherein each staple comprises a crown and two legs extending from the crown, and wherein the driver is configured to engage the crown and each of the second ends of the first and second clincher anvils is configured to engage one of the legs.

8. The fastener driving tool according to claim 5, wherein the first clincher anvil and the second clincher anvil each have an arcuate shape and extend arcuately downwardly from the respective second ends of the first clincher arm and the second clincher arm.

9. The fastener driving tool according to claim 8, wherein a distal tip of the first clincher anvil and a distal tip of the second clincher anvil are each configured to pierce through the workpiece as the first clincher anvil and the second clincher anvil move downwardly and inwardly into the clinching position.

10. The fastener driving tool according to claim 9, wherein the workpiece is a corrugated fiberboard container.

11. The fastener driving tool according to claim 1, further comprising a trigger mechanically coupled to a handle portion of the housing and electrically coupled to the motor, and an energy storage device connected to the handle portion, and wherein the trigger is configured to selectively provide electric power from the energy storage device to the motor when a user of the fastener driving tool operates the trigger while holding the handle portion.

12. The fastener driving tool according to claim 11, wherein the energy storage device comprises a battery pack.

13. The fastening driving tool according to claim 1, wherein the connecting rod is pivotably connected to the mount at the one end portion thereof using a first connector.

14. The fastening driving tool according to claim 13, wherein the housing comprises a first aperture to enable access to the first connector disposed within the housing.

15. The fastening driving tool according to claim 14, wherein the first connector is constructed and arranged to be coaxial with the first aperture to allow the first connector to be removed from the tool through the first aperture.

16. The fastening driving tool according to claim 15, wherein the clincher comprises a pair of clincher anvils.

17. The fastening driving tool according to claim 16, further comprises a pair of second connectors, wherein each second connector is constructed and arranged to connect one of the clincher anvils to a corresponding portion of the clincher.

18. The fastening driving tool according to claim 17, wherein the housing comprises a pair of second apertures, wherein each second aperture is constructed and arranged to enable access to the respective second connector.

19. The fastening driving tool according to claim 18, wherein the pair of second connectors are constructed and arranged to be coaxial with the pair of second apertures to allow each second connector to be removed from the tool through the corresponding second aperture.

20. The fastening driving tool according to claim 19, further comprises a cover that covers the first aperture, wherein removing the cover from the housing exposes the first connector through the first aperture, and wherein the exposed first connector is removed from the tool through the first aperture.

21. The fastening driving tool according to claim 20, wherein, when the first connector is removed from the tool through the first aperture, the mount is free to move from an upper position of the drive stroke vertically downward to a bottom position of the drive stroke of the driver, which causes the clincher to also move vertically downward.

22. The fastening driving tool according to claim 21, wherein, when the pair of second connectors are removed from the tool through the pair of second apertures, the clincher anvils are freed from the rest of the clincher and configured to be removed from the tool.

23. The fastening driving tool according to claim 22, wherein replacement clincher anvils are secured to the clincher by aligning the replacement clincher anvils with their respective portions of the clincher and inserting the removed pair of second connectors through the pair of second apertures.

24. The fastening driving tool according to claim 23, wherein, after the replacement clincher anvils are secured to the clincher, the mount and the driver are moved upward in the drive track, and the removed first connector is inserted through the first aperture in the housing and into the mount and connecting rod, thereby connecting the mount to the connecting rod.

* * * * *